US008079419B2

(12) United States Patent
Richards

(10) Patent No.: US 8,079,419 B2
(45) **Date of Patent: *Dec. 20, 2011**

(54) APPARATUS AND METHOD FOR CONTROLLING THE CONNECTION AND DISCONNECTION SPEED OF DOWNHOLE CONNECTORS

(75) Inventor: William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/007,926

(22) Filed: Jan. 17, 2011

(65) Prior Publication Data

US 2011/0108288 A1 May 12, 2011

Related U.S. Application Data

(63) Continuation of application No. 12/372,862, filed on Feb. 18, 2009.

(51) Int. Cl.
*E21B 17/02* (2006.01)

(52) U.S. Cl. ..... 166/380; 166/242.6

(58) Field of Classification Search ..... 166/380, 166/381, 65.1, 242.6, 242.7
See application file for complete search history.

(56) References Cited

U.S. PATENT DOCUMENTS

| | | | | |
|---|---|---|---|---|
| 6,510,899 | B1 * | 1/2003 | Sheiretov et al. | 166/381 |
| 7,398,822 | B2 * | 7/2008 | Meijer et al. | 166/242.7 |
| 2006/0260818 | A1 * | 11/2006 | Meijer et al. | 166/380 |
| 2008/0029274 | A1 * | 2/2008 | Rytlewski et al. | 166/375 |
| 2008/0047703 | A1 * | 2/2008 | Stoesz et al. | 166/65.1 |
| 2008/0302527 | A1 * | 12/2008 | Coronado et al. | 166/242.1 |
| 2009/0194275 | A1 * | 8/2009 | Bissonnette et al. | 166/250.01 |

* cited by examiner

*Primary Examiner* — William P Neuder
(74) *Attorney, Agent, or Firm* — Lawrence R. Youst

(57) ABSTRACT

An apparatus (100) for controlling the connection speed of downhole connectors (316, 146) in a subterranean well. The apparatus (100) includes a first assembly that is positionable in the well. The first assembly includes a first downhole connector (316) and a first communication medium. A second assembly includes a second downhole connector (146) and a second communication medium. The second assembly has an outer portion and an inner portion. The outer portion is selectively axially shiftable relative to an inner portion, such that upon engagement of the first assembly with the second assembly, the outer portion of the second assembly is axially shifted relative to the inner portion of the second assembly allowing the first and second downhole connectors (316, 146) to be operatively connected to each other, thereby enabling communication between the first communication medium and the second communication medium.

22 Claims, 9 Drawing Sheets

APPARATUS AND METHOD FOR CONTROLLING THE CONNECTION AND DISCONNECTION SPEED OF DOWNHOLE CONNECTORS

CROSS-REFERENCE TO RELATED APPLICATIONS

This is a continuation of co-pending application Ser. No. 12/372,862, filed Feb. 18, 2009.

FIELD OF THE INVENTION

This invention relates, in general, to equipment utilized and operations performed in conjunction with a subterranean well and, in particular, to an apparatus and method for controlling the connection and disconnection speed of downhole connectors.

BACKGROUND OF THE INVENTION

Without limiting the scope of the present invention, its background is described with reference to using optical fibers for communication and sensing in a subterranean wellbore environment, as an example.

It is well known in the subterranean well completion and production arts that downhole sensors can be used to monitor a variety of parameters in the wellbore environment. For example, during a treatment operation, it may be desirable to monitor a variety of properties of the treatment fluid such as viscosity, temperature, pressure, velocity, specific gravity, conductivity, fluid composition and the like. Transmission of this information to the surface in real-time or near real-time allows the operators to modify or optimize such treatment operations to improve the completion process. One way to transmit this information to the surface is through the use of an energy conductor which may take the form of one or more optical fibers.

In addition or as an alternative to operating as an energy conductor, an optical fiber may serve as a sensor. It has been found that an optical fiber may be used to obtain distributed measurements representing a parameter along the entire length of the fiber. Specifically, optical fibers have been used for distributed downhole temperature sensing, which provides a more complete temperature profile as compared to discrete temperature sensors. In operation, once an optical fiber is installed in the well, a pulse of laser light is sent along the fiber. As the light travels down the fiber, portions of the light are backscattered to the surface due to the optical properties of the fiber. The backscattered light has a slightly shifted frequency such that it provides information that is used to determine the temperature at the point in the fiber where the backscatter originated. In addition, as the speed of light is constant, the distance from the surface to the point where the backscatter originated can also be determined. In this manner, continuous monitoring of the backscattered light will provide temperature profile information for the entire length of the fiber.

Use of an optical fiber for distributed downhole temperature sensing may be highly beneficial during the completion process. For example, in a stimulation operation, a temperature profile may be obtained to determine where the injected fluid entered formations or zones intersected by the wellbore. This information is useful in evaluating the effectiveness of the stimulation operation and in planning future stimulation operations. Likewise, use of an optical fiber for distributed downhole temperature sensing may be highly beneficial during production operations. For example, during a production operation a distributed temperature profile may be used in determining the location of water or gas influx along the sand control screens. In a typical completion operation, a lower portion of the completion string including various tools such as sand control screens, fluid flow control devices, wellbore isolation devices and the like is permanently installed in the wellbore. As discussed above, the lower portion of the completion string may include various sensors, particularly, a lower portion of the optical fiber. After the completion process is finished, an upper portion of the completions string which includes the upper portion of the optical fiber is separated from the lower portion of the completion string and retrieved to the surface. This operation cuts off communication between the lower portion of the optical fiber and the surface. Accordingly, if information from the production zones is to be transmitted to the surface during production operations, a connection to the lower portion of the optical fiber must be reestablished when the production tubing string is installed.

It has been found, however, that wet mating optical fibers in a downhole environment is very difficult. This difficulty is due in part to the lack of precision in the axially movement of the production tubing string relative to the previously installed completion string. Specifically, the production tubing string is installed in the wellbore by lowering the block at the surface, which is thousands of feet away from the downhole landing location. In addition, neither the distance the block is moved nor the speed at which the block is moved at the surface directly translates to the movement characteristics at the downhole end of the production tubing string due to static and dynamic frictional forces, gravitational forces, fluid pressure forces and the like. The lack of correlation between block movement and the movement of the lower end of the production tubing string is particularly acute in slanted, deviated and horizontal wells. This lack in precision in both the distance and the speed at which the lower end of the production tubing string moves has limited the ability to wet mate optical fibers downhole as the wet mating process requires relatively high precision to sufficiently align the fibers to achieve the required optical transmissivity at the location of the connection.

Therefore, a need has arisen for an apparatus and method for wet connecting optical fibers in a subterranean wellbore environment. A need has also arisen for such an apparatus and method for wet connecting optical fibers that is operable to overcome the lack of precision in the axial movement of downhole pipe strings relative to one another. Further, a need has arisen for such an apparatus and method for wet connecting optical fibers that is operable to overcome the lack of precision in the speed of movement of downhole pipe strings relative to one another.

SUMMARY OF THE INVENTION

The present invention disclosed herein is directed to an apparatus and method for wet connecting downhole communication media in a subterranean wellbore environment. The apparatus and method of the present invention are operable to overcome the lack of precision in the axial movement of downhole pipe strings relative to one another. In addition, apparatus and method of the present invention are operable to overcome the lack of precision in the speed of movement of downhole pipe strings relative to one another. In carrying out the principles of the present invention, a wet connection apparatus and method are provided that are operable to control the connection speed of downhole connectors.

In one aspect, the present invention is directed to a method for controlling the connection speed of first and second downhole connectors in a subterranean well. The method includes positioning a first assembly in the well, the first assembly including the first downhole connector and a first communication medium; engaging the first assembly with a second assembly, the second assembly including the second downhole connector and a second communication medium; axially shifting an outer portion of the second assembly relative to an inner portion of the second assembly; and then operatively connecting the first and second downhole connectors to each other, thereby enabling communication between the first and second communication media.

In one embodiment, the method includes releasing a lock initially coupling the outer and inner portions of the second assembly. This step may be performed by radially inwardly compressing a collet assembly of the outer portion of the second assembly with an inner surface of the first assembly. In another embodiment, the method includes controlling the rate at which the outer and inner portions of the second assembly axially shift relative to one another with a resistance assembly. This step may be performed by metering a fluid through a transfer piston. In a further embodiment, the method includes anchoring the second assembly within the first assembly. This step may be performed by engaging a collet assembly of the outer portion of the second assembly with a profile of the first assembly. In yet another embodiment, the method may include disposing the first downhole connector of the first assembly at a location uphole of a packer of the first assembly. In any of the embodiments, the communication media may be optical fibers, electrical conductors, hydraulic fluid or the like. When the first communication medium is an optical fiber, this optical fiber may be operated as a sensor such as a distributed temperature sensor.

In another aspect, the present invention is directed to a method for controlling the connection speed of first and second fiber optic connectors in a subterranean well. The method includes positioning a first assembly in the well, the first assembly including the first fiber optic connector and a first optical fiber; engaging the first assembly with a second assembly, the second assembly including the second fiber optic connector and a second optical fiber; axially shifting an outer portion of the second assembly relative to an inner portion of the second assembly while metering a fluid through a transfer piston to control the rate at which the outer and inner portions of the second assembly axially shift relative to one another; and then operatively connecting the first and second fiber optic connectors to each other, thereby enabling light transmission between the optical fibers.

In a further aspect, the present invention is directed to an apparatus for controlling the connection speed of first and second downhole connectors in a subterranean well. The apparatus includes a first assembly that is positionable in the well. The first assembly includes the first downhole connector and a first communication medium. A second assembly includes the second downhole connector and a second communication medium. The second assembly has an outer portion and an inner portion that are selectively axially shiftable relative to one another such that upon engagement of the first assembly with the second assembly, the outer portion of the second assembly is axially shifted relative to the inner portion of the second assembly allowing the first and second downhole connectors to be operatively connected to each other, thereby enabling communication between the first communication medium and the second communication medium.

In one embodiment, the inner portion of the second assembly includes a lock and the outer portion of the second assembly includes a collet assembly. The lock initially couples the outer and inner portions of the second assembly together and the collet is operable to release the lock in response to being radially inwardly compressed by an inner surface of the first assembly. In another embodiment, the apparatus includes a resistance assembly that is positioned between the outer portion of the second assembly and the inner portion of the second assembly that controls the rate at which the outer and inner portions of the second assembly axially shift relative to one another by, for example, metering a fluid through a transfer piston. In a further embodiment, the outer portion of the second assembly includes a collet assembly and the first assembly includes a profile. In this embodiment, the collet assembly is operable to engage the profile to anchor the second assembly within the first assembly. In yet another embodiment, the first assembly includes a packer and the first downhole connector of the first assembly is positioned at a location uphole of the packer.

In yet another aspect, the present invention is directed to a method for controlling the disconnection speed of first and second downhole connectors in a subterranean well. The method includes establishing a predetermined tensile force between a first assembly and a second assembly in the well, the first assembly including the first downhole connector and a first communication medium, the second assembly including the second downhole connector and a second communication medium; axially shifting an outer portion of the second assembly relative to an inner portion of the second assembly; and operatively disconnecting the first and second downhole connectors from each other, thereby disabling communication between the first and second communication media.

In one embodiment, the method may include releasing an anchor of the second assembly from a profile in the first assembly. This step may be performed by radially inwardly compressing a collet assembly of the second assembly with an inner surface of the first assembly. In another embodiment, the method may include controlling the rate at which the outer and inner portions of the second assembly axially shift relative to one another with a resistance assembly. This step may be performed by metering a fluid through a transfer piston.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
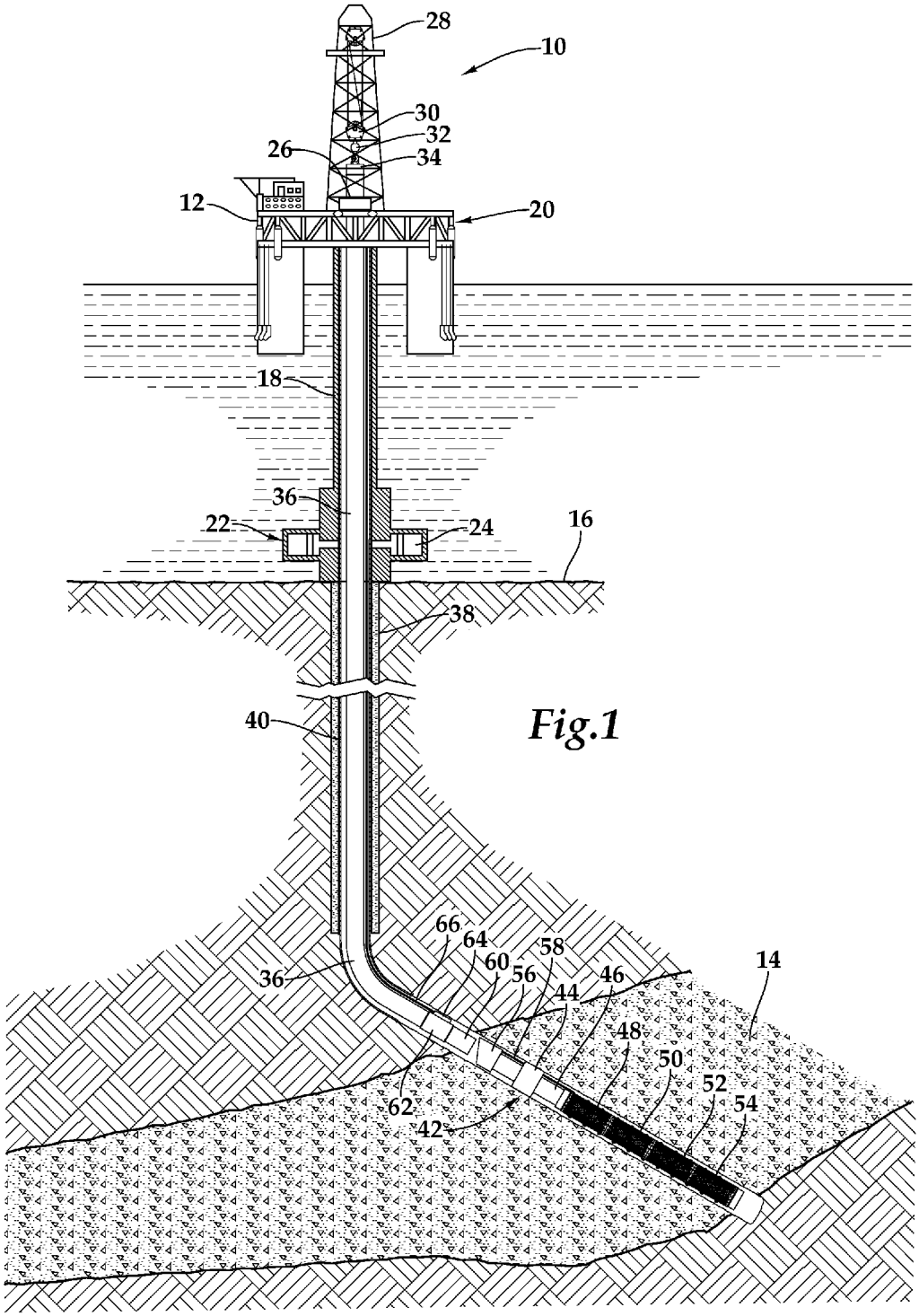
FIG. 1 is a schematic illustration of an offshore oil and gas platform operating an apparatus for controlling the connection speed of downhole connectors according to an embodiment of the present invention.
Figure 2A:
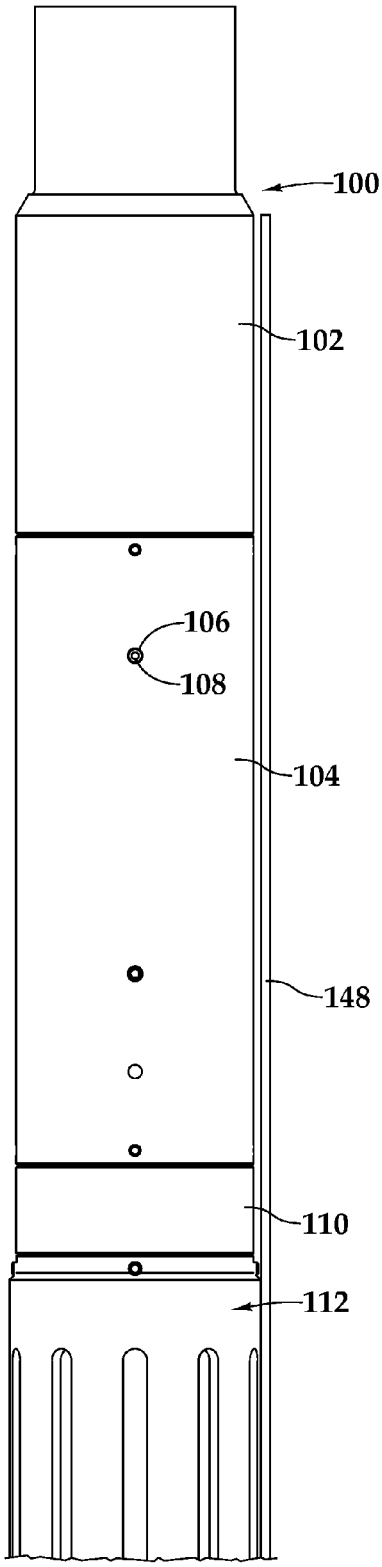
FIGS. 2A-2D are front views of consecutive axial sections of an apparatus for controlling the connection speed of downhole connectors in a running configuration according to an embodiment of the present invention.
Figure 3A:
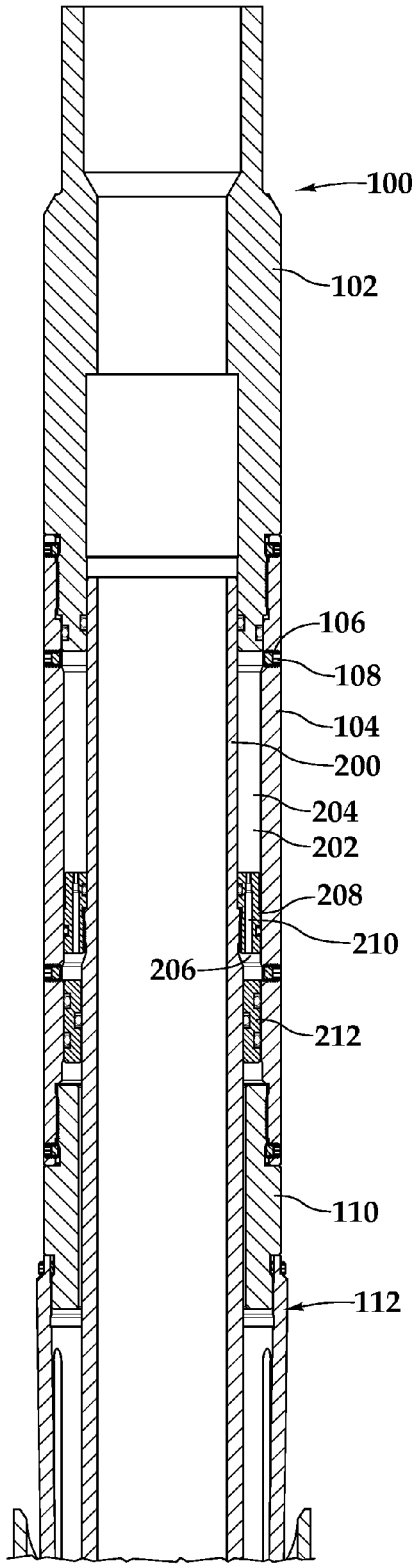
FIGS. 3A-3D are cross sectional views of consecutive axial sections of an apparatus for controlling the connection speed of downhole connectors in a running configuration according to an embodiment of the present invention.
Figure 2B:
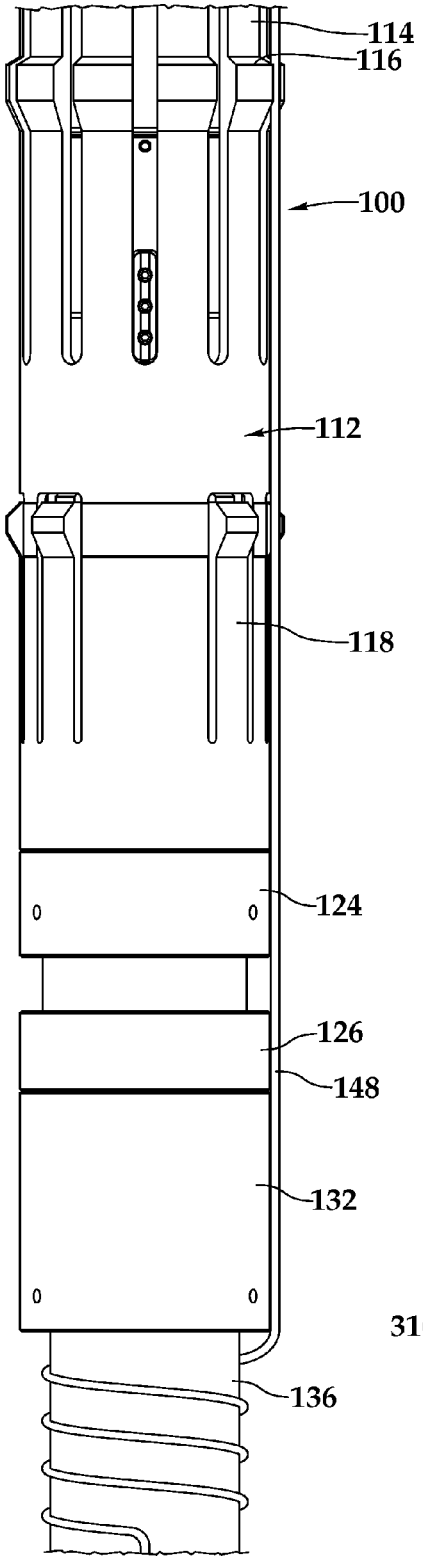
Figure 3B:
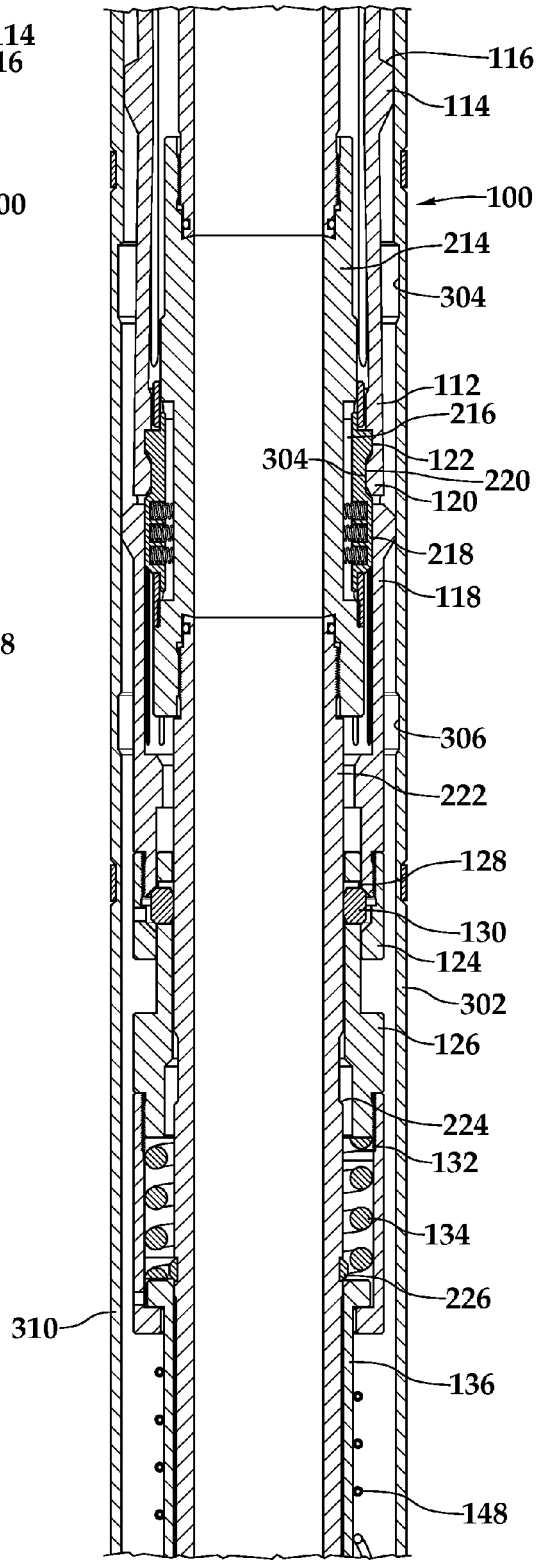
Figure 2C:
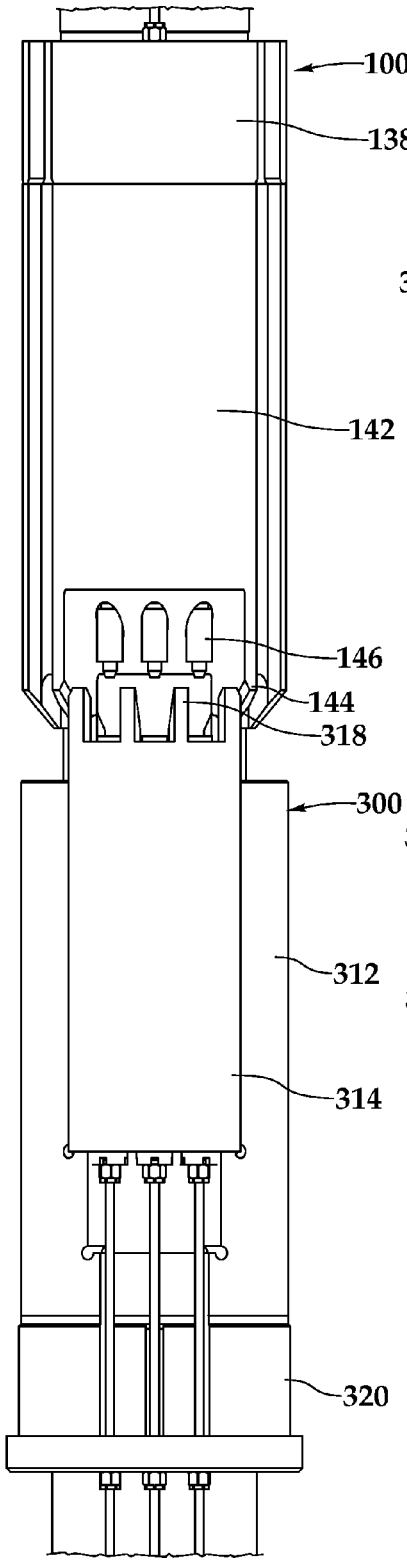
Figure 3C:
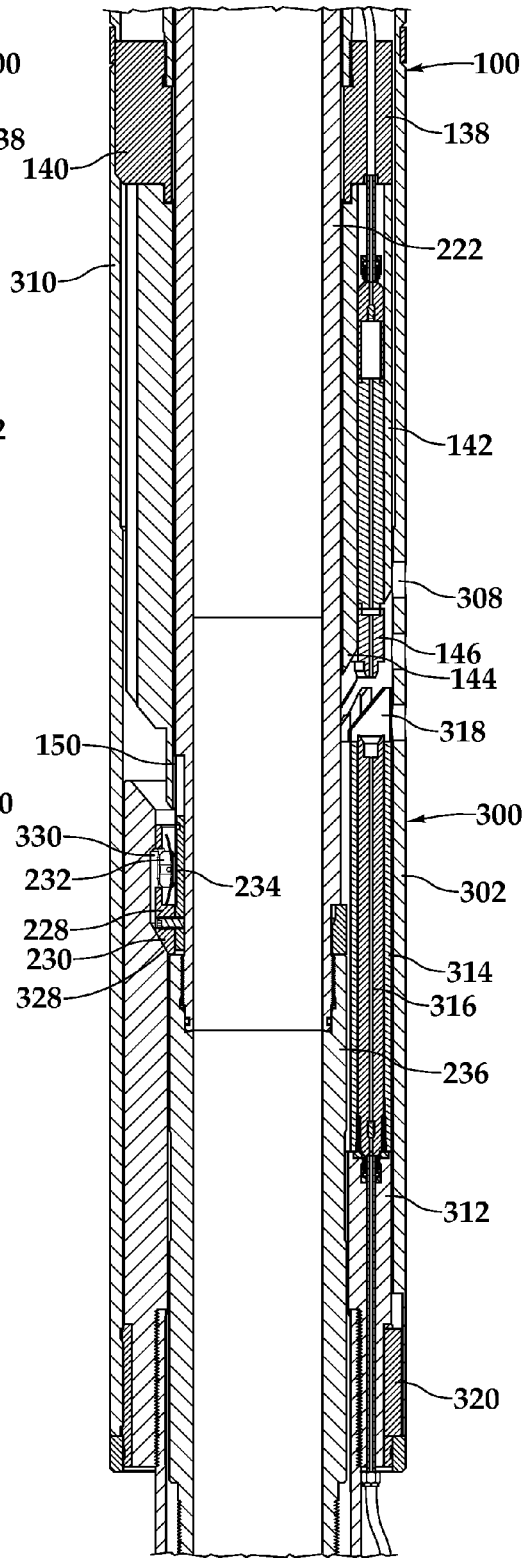
Figure 2D:
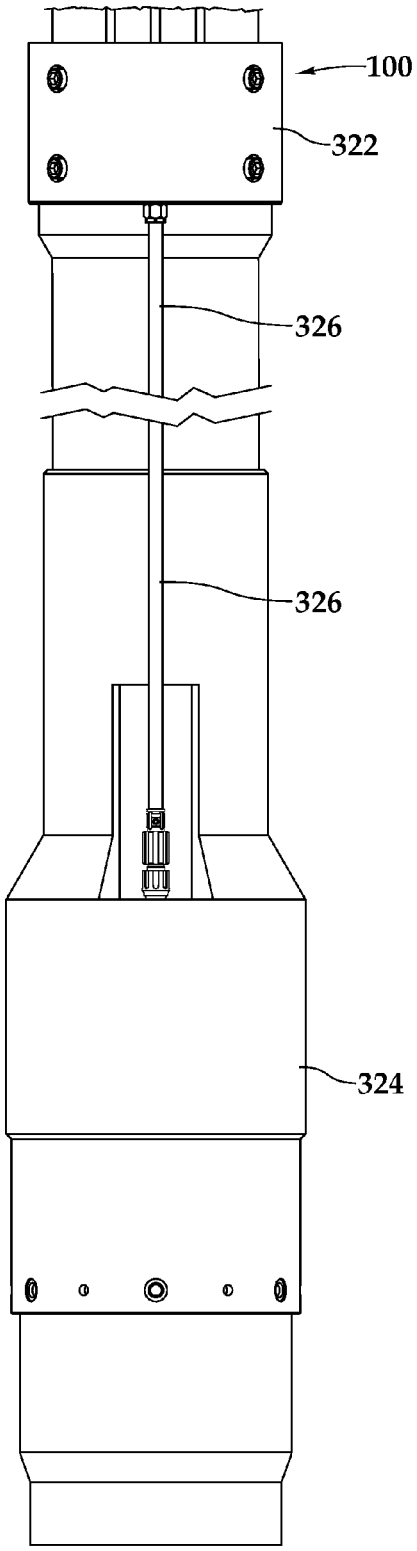
Figure 3D:
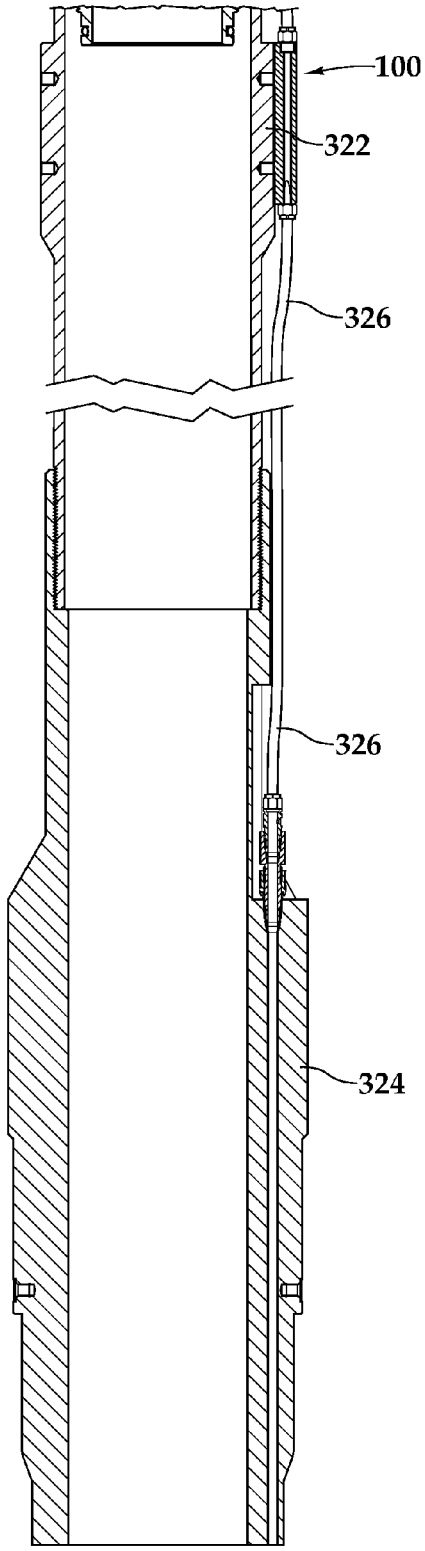
Figure 4A:
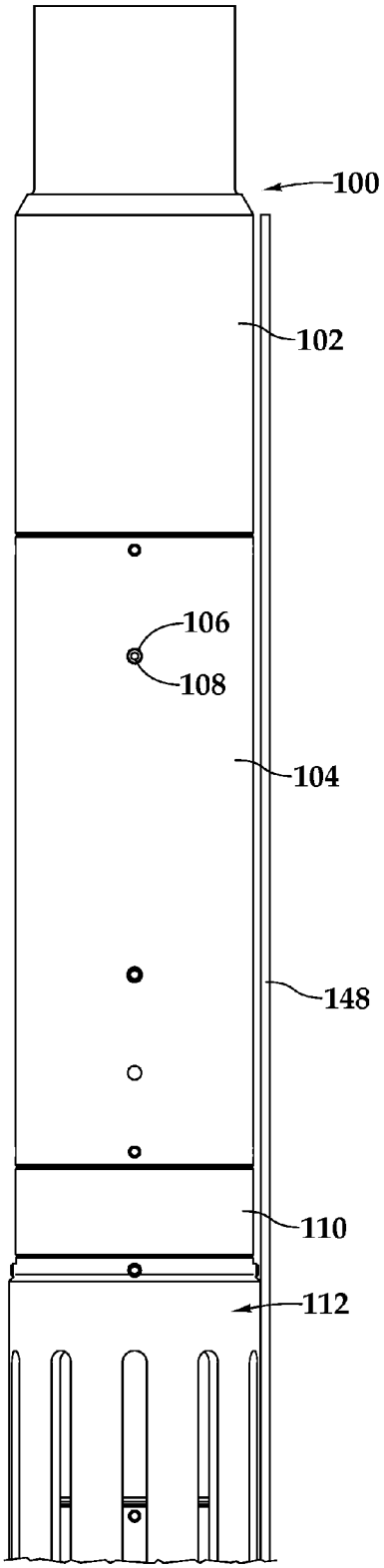
FIGS. 4A-4D are front views of consecutive axial sections of an apparatus for controlling the connection speed of downhole connectors in an anchored configuration according to an embodiment of the present invention.
Figure 5A:
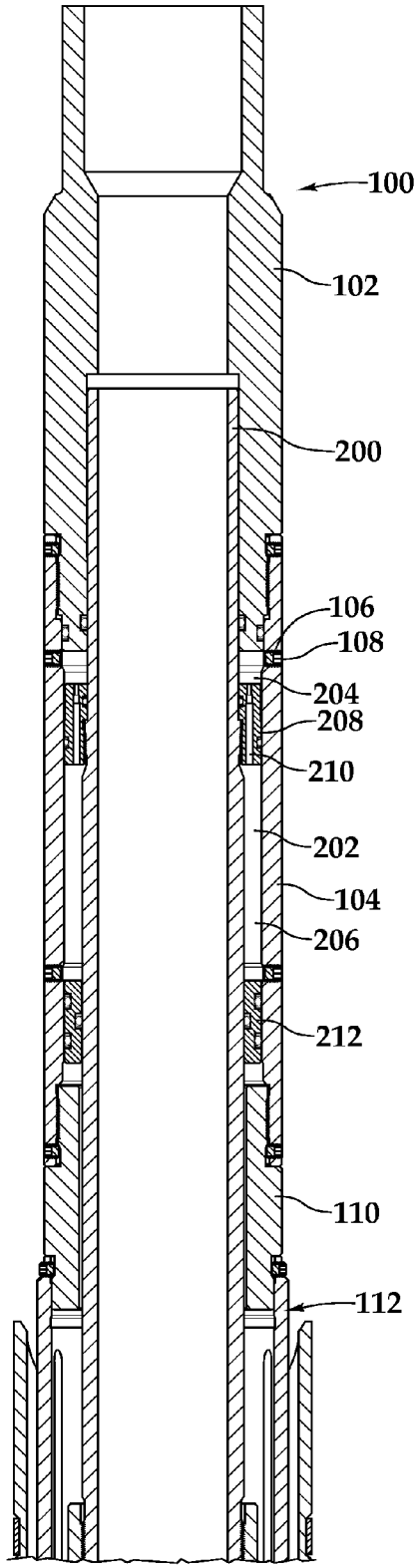
FIGS. 5A-5D are cross sectional views of consecutive axial sections of an apparatus for controlling the connection speed of downhole connectors in an anchored configuration according to an embodiment of the present invention.
Figure 4B:
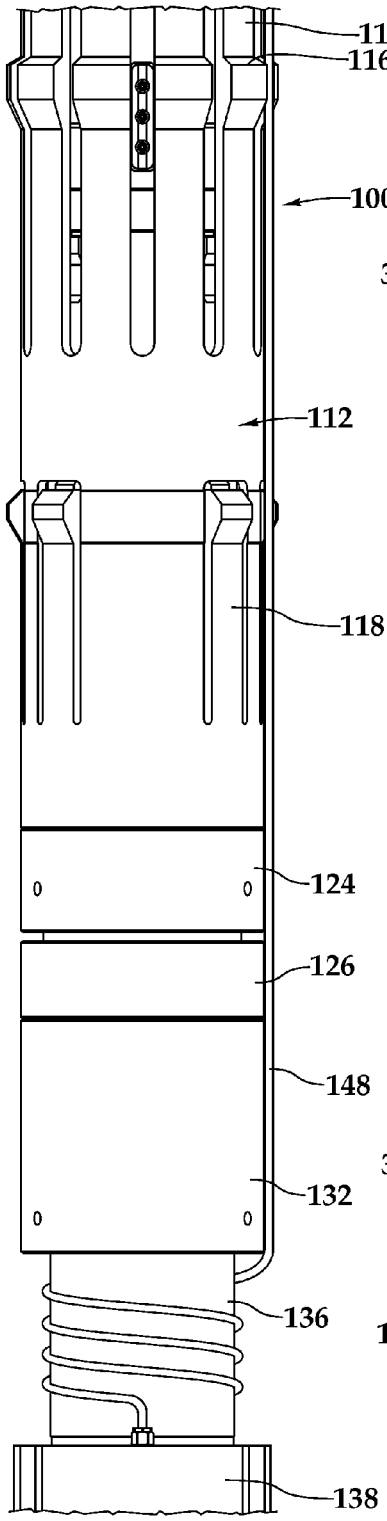
Figure 5B:
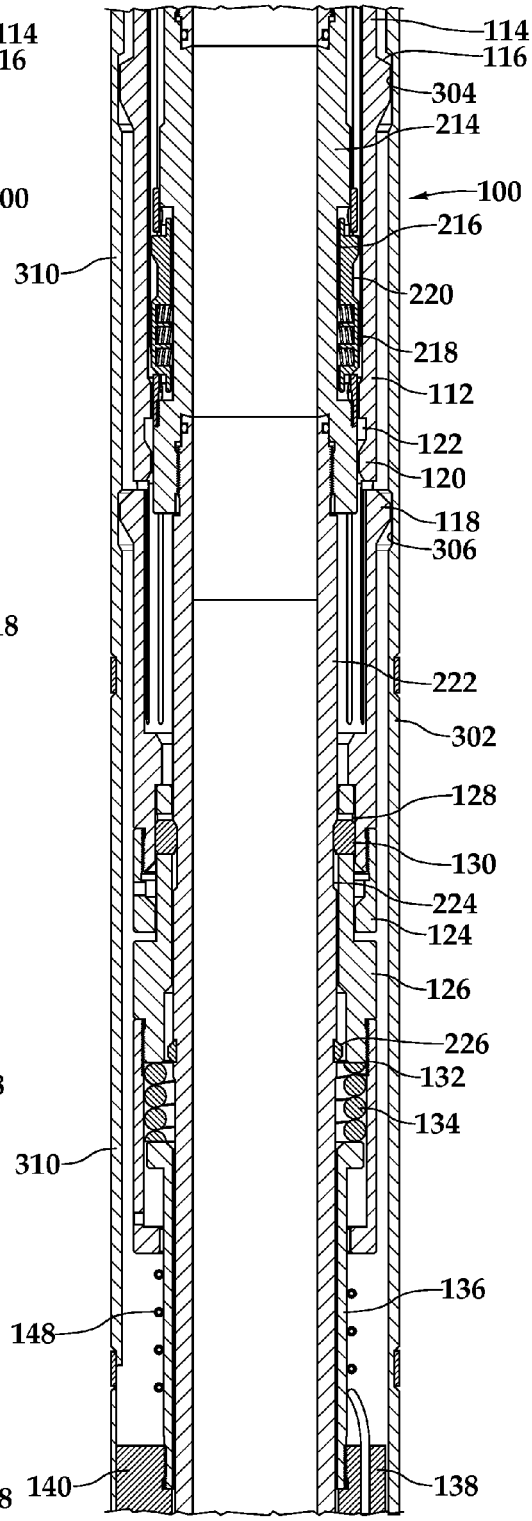
Figure 4C:
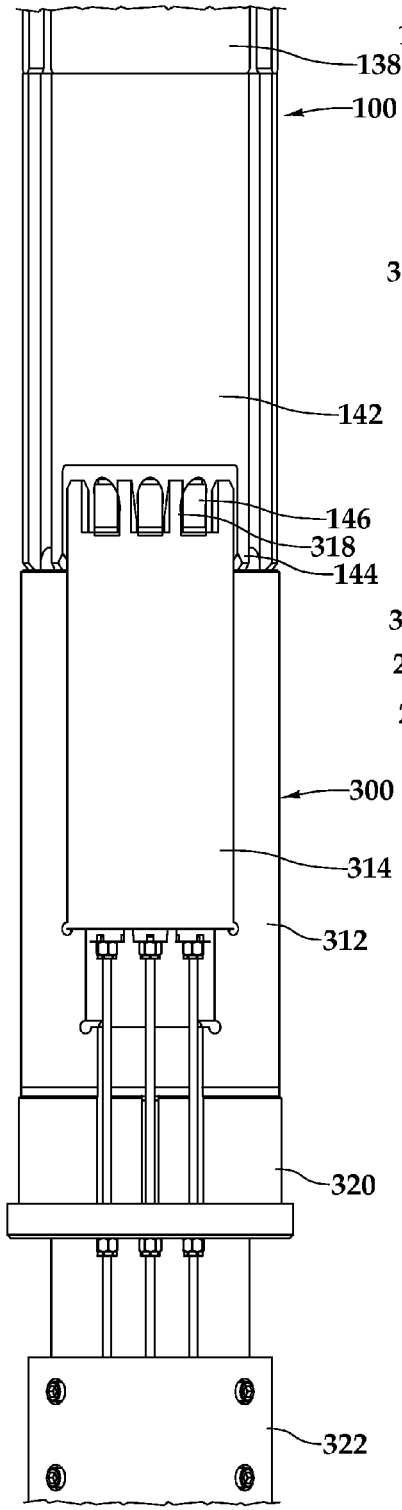
Figure 5C:
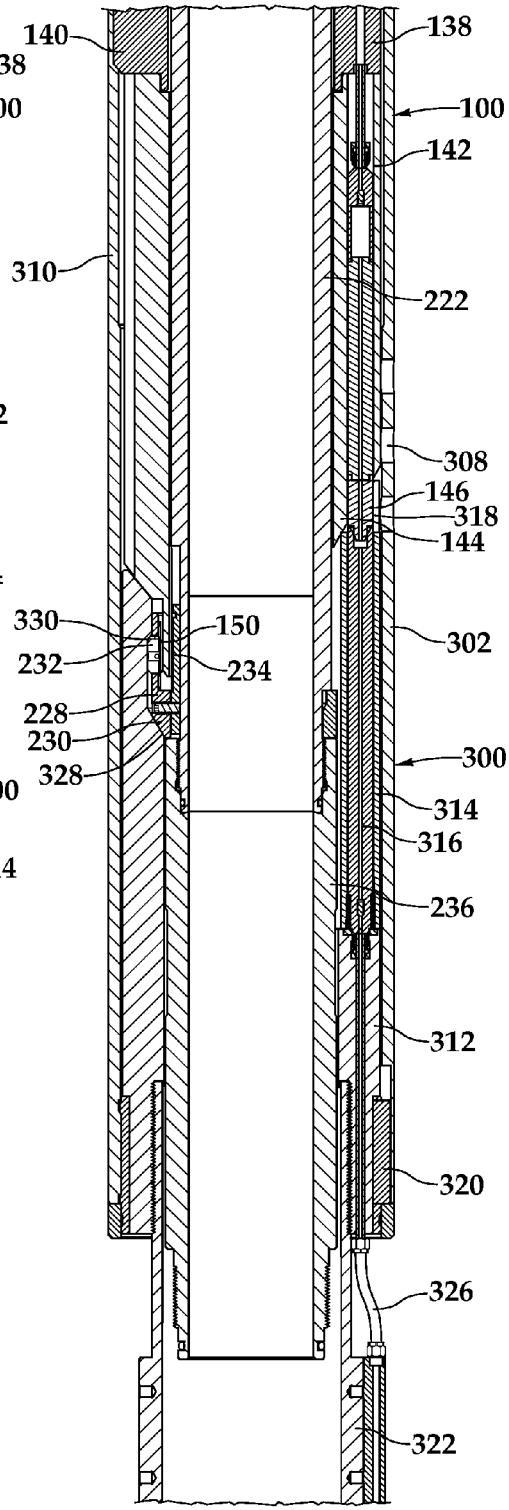
Figure 4D:
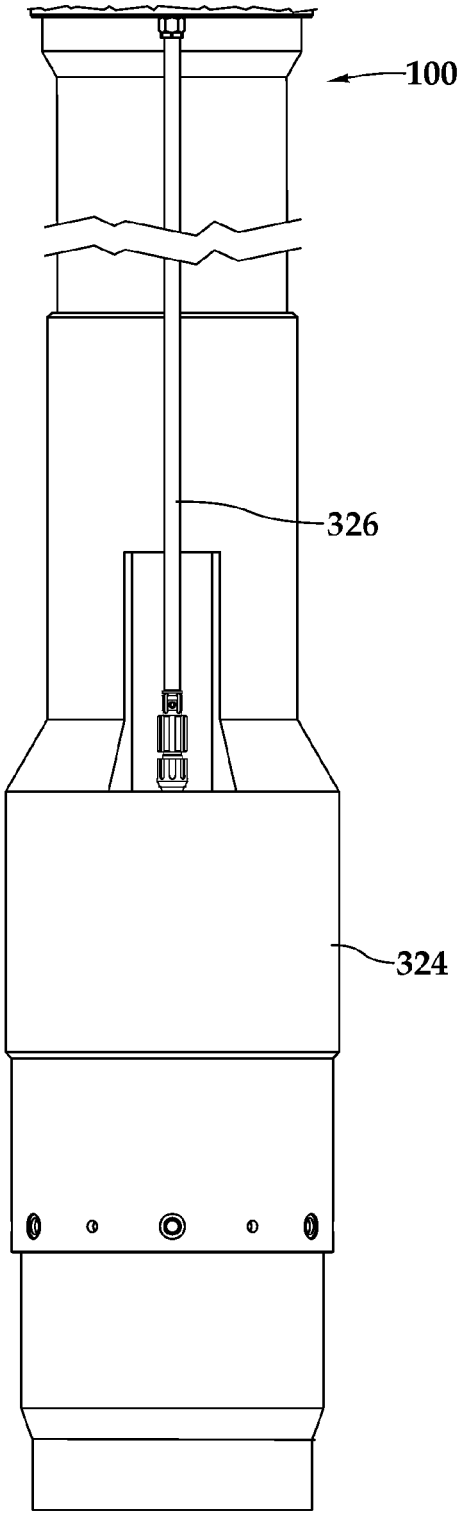
Figure 5D:
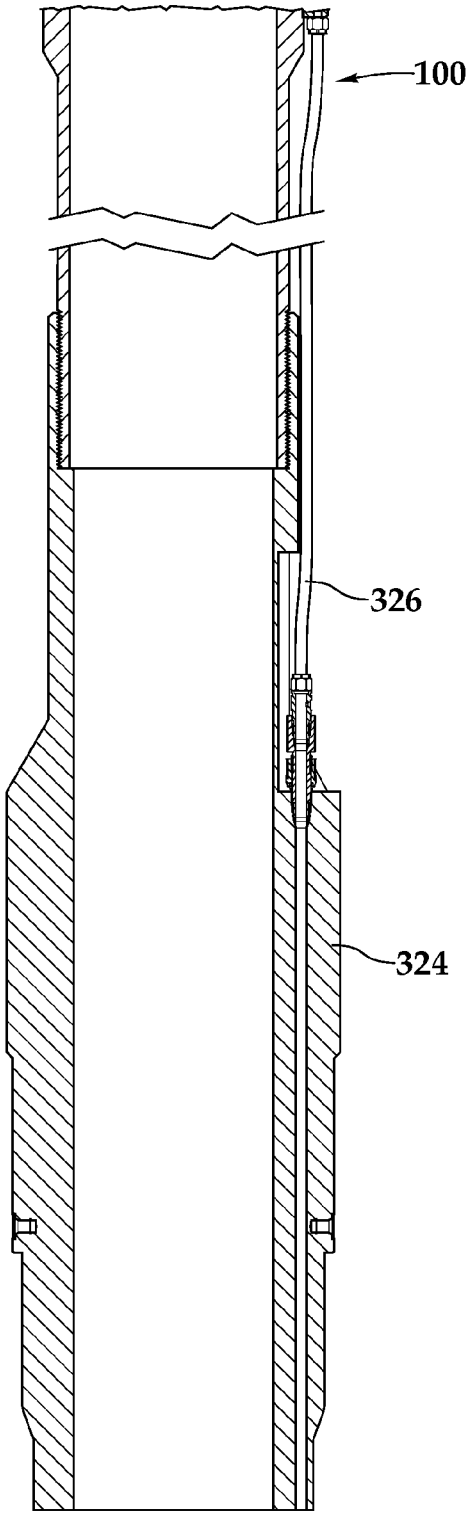

Referring initially to FIG. 1, an apparatus for controlling the connection speed of downhole connectors deployed from an offshore oil or gas platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending production tubing 36.

A wellbore 38 extends through the various earth strata including formation 14. An upper portion of wellbore 38 includes casing 40 that is cemented within wellbore 38. Disposed in an open hole portion of wellbore 38 is a completion that includes various tools such as packer 44, a seal bore assembly 46 and sand control screen assemblies 48, 50, 52, 54. In the illustrated embodiment, completion 42 also includes an orientation and alignment subassembly 56 that houses a downhole wet mate connector. Extending downhole from orientation and alignment subassembly 56 is a conduit 58 that passes through packer 44 and is operably associated with sand control screen assemblies 48, 50, 52, 54. Preferably, conduit 58 is a spoolable metal conduit, such as a stainless steel conduit that may be attached to the exterior of pipe strings as they are deployed in the well. In the illustrated embodiment, conduit 58 is wrapped around sand control screen assemblies 48, 50, 52, 54. One or more communication media such as optical fibers, electrical conducts, hydraulic fluid or the like may be disposed within conduit 58. In certain embodiments, the communication media may operate as energy conductors including power and data transmission between downhole a location or downhole sensors (not pictured) and the surface. In other embodiments, the communication media may operate as downhole sensors.

For example, when optical fibers are used as the communication media, the optical fibers may be used to obtain distributed measurements representing a parameter along the entire length of the fiber such as distributed temperature sensing. In this embodiment, a pulse of laser light from the surface is sent along the fiber and portions of the light are backscattered to the surface due to the optical properties of the fiber. The slightly shifted frequency of the backscattered light provides information that is used to determine the temperature at the point in the fiber where the backscatter originated. In addition, as the speed of light is constant, the distance from the surface to the point where the backscatter originated can also be determined. In this manner, continuous monitoring of the backscattered light will provide temperature profile information for the entire length of the fiber.

Disposed in wellbore 38 at the lower end of production tubing string 36 are a variety of tools including seal assembly 60 and anchor assembly 62 including downhole wet mate connector 64. Extending uphole of connector 64 is a conduit 66 that extends to the surface in the annulus between production tubing string 36 and wellbore 38 and is suitable coupled to production tubing string 36 to prevent damage to conduit 66 during installation. Similar to conduit 58, conduit 66 may have one or more communication media, such as optical fibers, electrical conducts, hydraulic fluid or the like disposed therein. Preferable, conduit 58 and conduit 66 will have the same type of communication media disposed therein such that energy may be transmitted therebetween following the connection process. As discussed in greater detail below, prior to producing fluids, such as hydrocarbon fluids, from formation 14, production tubing string 36 and completion 42 are connected together. When properly connected to each other, a sealed communication path is created between seal assembly 60 and seal bore assembly 46 which establishes a sealed internal flow passage from completion 42 to production tubing string 36, thereby providing a fluid conduit to the surface for production fluids. In addition, as discussed in greater detail below, the present invention enables the communication media associated with conduit 66 to be operatively connected to the communication media associated with conduit 58, thereby enabling communication therebetween and, in the case of optical fiber communication media, enabling distributed temperature information to be obtained along completion 42 during the subsequent production operations.

Even though FIG. 1 depicts a slanted wellbore, it should be understood by those skilled in the art that the apparatus for controlling the connection speed of downhole connectors according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the apparatus for controlling the connection speed of downhole connectors according to the present invention is equally well suited for use in onshore operations. Further, even though FIG. 1 depicts an open hole completion, it should be understood by those skilled in the art that the apparatus for controlling the connection speed of downhole connectors according to the present invention is equally well suited for use in cased hole completions.

Referring now to FIGS. 2 and 3, including FIGS. 2A-2D and FIGS. 3A-3D, therein is depicted successive axial section of an apparatus for controlling the connection speed of downhole connectors that is generally designated 100. It is noted that FIGS. 2A-2D and FIGS. 3A-3D as well as FIGS. 4A-4D and 5A-5D below are described with reference to optical fibers as the communication media. As discussed above, those skilled in the art will recognize that the present invention is not limited to this illustrated embodiment but instead encompasses other communication media including, but not limited to, electrical conductors and hydraulic fluid. Also, as described above, apparatus 100 is formed from certain components that are initially installed downhole as part of completion 42 and certain components that are carried on the lower end of production tubing string 36. As illustrated in FIG. 2, some the components carried on the lower end of production tubing string 36 have come in contact with certain components of completion 42 prior to connecting the respective wet mate connectors together. The entire apparatus 100 will now be described from its uphole end to its downhole end, first describing the exterior parts of the components carried on the lower end of production tubing string 36, followed by the interior parts of the components carried on the lower end of production tubing string 36 then describing the components previously installed downhole as part of completion 42.

Apparatus 100 includes a substantially tubular axially extending upper connector 102 that is operable to be coupled to the lower end of production tubing string 36 by threading or other suitable means. At its lower end, upper connector 102 is threadedly and sealingly connected to the upper end of a substantially tubular axially extending hone bore 104. Hone bore 104 includes a plurality of lateral opening 106 having plugs 108 disposed therein. At its lower end, hone bore 104 is securably connected to the upper end of a substantially tubular axially extending connector member 110. At its lower end, connector member 110 is securably connected to the upper end of an axially extending collet assembly 112. Collet assembly 112 includes a plurality of circumferentially disposed anchor collets 114, each having an upper surface 116. In addition, collet assembly 112 includes a plurality of circumferentially disposed unlocking collets 118. Further, collet assembly 112 includes a plurality of radially inwardly extending protrusions 120 and profiles 122. At its lower end, collet assembly 112 is threadedly coupled to the upper end of a substantially tubular axially extending key retainer 124. A portion of collet assembly 112 and key retainer 124 are both slidably disposed about the upper end of a substantially tubular axially extending key mandrel 126. Key mandrel 126 includes a key window 128 into which a spring key 130 is received.

At its lower end, key mandrel 126 is threadedly coupled to the upper end of a substantially tubular axially extending spring housing 132. Disposed within spring housing 132 is an axially extending spiral wound compression spring 134. At its lower end, spring housing 132 is slidably disposed about the upper end of a substantially tubular axially extending connector member 136. At its lower end, connector member 136 is threadedly coupled to the upper end of a substantially tubular axially extending splitter 138. Splitter 138 includes an orientation key 140 disposed about a circumferential portion of splitter 138. At its lower end, splitter 138 is coupled to the upper end of a substantially tubular axially extending fiber optic wet mate head 142 by threading, bolting or other suitable technique. Fiber optic wet mate head 142 includes a plurality of guide members 144. In the illustrated embodiment, fiber optic wet mate head 142 has three fiber optic wet mate connectors 146 disposed therein. Each of the fiber optic wet mate connectors 146 has an optical fiber disposed therein. As illustrated, the three optical fibers associated with fiber optic wet mate connectors 146 passed through splitter 138 and are housed within a single conduit 148 that wraps around connector member 136 and extends uphole along the exterior of apparatus 100. Conduit 148 is secured to apparatus 100 by banding or other suitable technique.

In the previous section, the exterior components of the portion of apparatus 100 carried by production tubing string 36 were described. In this section, the interior components of the portion of apparatus 100 carried by production tubing string 36 will be described. At its upper end, apparatus 100 includes a substantially tubular axially extending piston mandrel 200 that is slidably and sealingly received within upper connector 102. Disposed between piston mandrel 200 and hone bore 104 is an annular oil chamber 202 including upper section 204 and lower section 206. Securably attached to piston mandrel 200 and sealing positioned within annular oil chamber 202 is a transfer piston 208. Transfer piston 208 includes one or more passageways 210 therethrough which preferably include orifices that regulate the rate at which a transfer fluid such as a liquid or gas and preferably an oil disposed within annular oil chamber 202 may travel therethrough. Preferably, a check valve may be disposed within each passageway 210 to allow the flow of oil to proceed in only one direction through that passageway 210. In this embodiment, certain of the check valves will allow fluid flow in the uphole direction while other of the check valves will allow fluid flow in the downhole direction. In this manner, the resistance to flow in the downhole direction can be different from the resistance to flow in the uphole direction which respectively determines the speed of coupling and decoupling of the downhole connectors of apparatus 100. For example, it may be desirable to couple the downhole connectors at a speed that is slower than the speed at which the downhole connectors are decoupled.

Disposed within annular oil chamber 202 is a compensation piston 212 that has a sealing relationship with both the inner surface of hone bore 104 and the outer surface of piston mandrel 200. At its lower end, piston mandrel 200 is threadedly and sealingly coupled to the upper end of a substantially tubular axially extending key block 214. Key block 214 has a radially reduced profile 216 into which spring mounted locking keys 218 are positioned. Locking keys 218 include a profile 220. At its lower end, key block 214 is threadedly and sealingly coupled to the upper end of a substantially tubular axially extending bottom mandrel 222. Bottom mandrel 222 includes a groove 224. A pickup ring 226 is positioned around bottom mandrel 222. Positioned near the lower end of bottom mandrel 222 is a key carrier 228 that has a no go surface 230. Disposed within key carrier 228 is a spring mounted locking key 232. Positioned between key carrier 228 and bottom mandrel 222 is a torque key 234. At its lower end, bottom mandrel 222 is threadedly and sealingly coupled to the upper end of a substantially tubular axially extending seal adaptor 236. At its lower end, seal adaptor 236 is threadedly and sealingly coupled to the upper end of one or more substantially tubular axially extending seal assemblies (not pictured) that establish a sealing relationship with an interior surface of completion 42.

In the previous two sections, the components of apparatus 100 carried by production tubing string 36 were described. Collectively, these components may be referred to as an anchor or anchoring assembly. In this section, the components of apparatus 100 installed with completion 42 will be described. Apparatus 100 includes an orientation and alignment subassembly 300 that includes a locating and orienting guide 302 that is illustrated in FIG. 3 but has been removed from FIG. 2 for clarity of illustration. Locating and orienting guide 302 includes a locking profile 304, a groove 306 and a plurality of fluid passageways 308. In addition, locating and orienting guide 302 includes a receiving slot 310. Disposed within locating and orienting guide 302, orientation and alignment subassembly 300 includes a top subassembly 312 that supports a fiber optic wet mate holder 314. In the illustrated embodiment, disposed within wet mate holder 314 are three wet mate connectors 316. At its upper end, wet mate holder 314 includes a plurality of guides 318. Positioned between top subassembly 312 and locating and orienting guide 302 is a key 320. At its lower end, top subassembly 312 is threadedly and sealingly coupled to the upper end of a substantially tubular axially extending splitter 322. At its lower end, splitter 322 is coupled to the upper end of one or more substantially tubular axially extending packers 324 by threading, bolting, fastening or other suitable technique. Each of the fiber optic wet mate connectors 316 has an optical fiber disposed therein. As illustrated, the three optical fibers associated with fiber optic wet mate holder 314 pass through splitter 322 and are housed within a single conduit 326 that extends through packer 324 and is wrapped around sand control screens 48, 50, 52, 54 as described above to obtain distributed temperature information, for example.

The operation of the apparatus for controlling the connection speed of downhole connectors according to the present invention will now be described. After the installation of completion 42 in the wellbore and the performance of any associated treatment processes wherein the optical fibers associated with completion 42 and companion optical fibers associated with the service tool string may deliver information to the surface, the service tool string is retrieved to the surface. In this process, the optical fibers associated with completion 42 and the optical fibers associated with the service tool string must be decoupled. In order to reuse the optical fibers associated with completion 42 during production, new optical fibers must be carried with production tubing string 36 and optically coupled to the optical fibers associated with completion 42.

In the present invention, conduit 148 is attached to the exterior of production tubing string 36 and extends from the surface to the anchor assembly. One or more optical fibers are disposed within conduit 148 which may be a conventional hydraulic line formed from stainless steel or similar material. The anchor assembly is lowered into the wellbore until the seal assemblies on its lower end enter completion 42. As production tubing string 36 is further lowered into the wellbore, orientation key 140 contacts the inclined surfaces of locating and orientating guide 302. This interaction rotates the anchor assembly until orientation key 140 locates within slot 310 which provides a relatively coarse circumferential alignment of fiber optic wet mate head 142 with fiber optic wet mate holder 314. The anchor assembly now continues to travel downwardly in completion 42 until no go surface 230 of key carrier 228 contacts an upwardly facing shoulder 328 of top subassembly 312. Prior to contact between no go surface 230 and upwardly facing shoulder 328, guides 144 of fiber optic wet mate head 142 and guides 318 of fiber optic wet mate holder 314 interact to provide more precise circumferential and axially alignment of the assemblies.

Once no go surface 230 contacts upwardly facing shoulder 328, further downward motion of the inner components of the anchor assembly stops. In this configuration, as best seen in FIGS. 2A-2D and 3A-3D, unlocking collets 118 are radially inwardly shifted due to contact with the inner surface of locating and orienting guide 302. This radially inward shifting causes the inner surfaces of unlocking collets 118 to contact unlocking keys 218 and compress the associated springs causing unlocking keys 218 to radially inwardly retract. In the retraced position, radially inwardly extending protrusions 120 are released from profile 220, thereby decoupling the outer portions of the anchor assembly from the inner portions of the anchor assembly. Relative axially movement of the outer portions of the anchor assembly and the inner portions of the anchor assembly is now permitted.

As continued downward force is placed on the anchor assembly by applying force to the production tubing string 36, upper connector 102 is urged downwardly relative to piston mandrel 200. The movement of upper connector 102 relative to piston mandrel 200 is resisted, however, by a resistance member. In the illustrated embodiment, the resistance member is depicted as transfer piston 208 and the fluid within annular oil chamber 202. Specifically, the speed at which upper connector 102 can move relative to piston mandrel 200 is determined by the size of the orifice within passageway 210 of transfer piston 208 as well as the type of fluid, including liquids, gases or combinations thereof, within annular oil chamber 202. As the downward force is applied to upper connector 102, the fluid from upper section 204 of annular oil chamber 202 transfers to lower section 206 of annular oil chamber 202 passing through passageway 210. In this manner, excessive connection speed of fiber optic wet mate connectors 146 and fiber optic wet mate connectors 316 is prevented. Even though the resistance member has been described as transfer piston 208 and the fluid within annular oil chamber 202, it should be understood by those skilled in the art that other types of resistance members could alternatively be used and are considered within the scope of the present invention, including, but not limited to, mechanical springs, fluid springs, fluid dampeners, shock absorbers and the like.

As best seen in FIGS. 4A-4D and 5A-5D, continued downward force on upper connector 102 not only enables connection of fiber optic wet mate connectors 146 and fiber optic wet mate connectors 316, but also, compresses the outer components of the anchor assembly and locks the anchor assembly within completion 42. Once the connection between fiber optic wet mate connectors 146 and fiber optic wet mate connectors 316 is established, thereby permitting light transmission between the optical fibers therein, continued downward force on upper connector 102 compresses spring 134. As spring 134 is compressed, spring housing 132 telescopes relative to connector member 136. This shortening of the outer components of the anchor assembly allows spring key 130 to engage groove 224 of bottom mandrel 222. Once spring key 130 has radially inwardly retracted, the outer components of the anchor assembly further collapse as collet assembly 112 and key retainer 124 telescope relative to key mandrel 126. This shortening allows anchor collets 114 to engage locking profile 304 which couples the anchor assembly within completion 42. Also, this shortening allows unlocking collets 118 to engage groove 306 which relaxes unlocking collets 118. In addition, the inner portions of the anchor assembly are independently secured within completion 42 as extension 150 on the lower end of fiber optic wet mate head 142 is positioned under locking key 232 such that locking key 232 engages profile 330 of top subassembly 312.

In this configuration, not only are fiber optic wet mate connectors 146 and fiber optic wet mate connectors 316 coupled together, there is a biasing force created by compressed spring 134 that assures the connections will not be lost. Specifically, compressed spring 134 downwardly biases connector member 136 which in turn applies a downward force on splitter 138 and fiber optic wet mate head 142. This force prevents any decoupling of fiber optic wet mate connectors 146 and fiber optic wet mate connectors 316. In addition, the interaction of surface 116 of anchor collets 114 with locking profile 304 of locating and orienting guide 302 prevents separation of the anchoring assembly and the completion 42. If it is desired to detach production tubing string 36 from completion 42, a significant tensile force must be applied to production tubing string 36 at the surface, for example, 20,000 lbs. This force is transmitted via upper connector 102, hone bore 104 and connector member 110 to collet assembly 112. When sufficient tensile force is provided, anchor collets 114 will release from locking profile 304. Thereafter, the outer portions of anchor assembly that were telescopically contracted can be telescopically extended including the release of energy from spring 134. In order to separate fiber optic wet mate connectors 146 and fiber optic wet mate connectors 316, the outer portions of the anchor assembly must be shifted relative to the inner portions of the anchor assembly. The rate of the axial shifting is again controlled by the metering rate of fluid through transfer piston 212. After the outer portions of the anchor assembly have been shifted relative to the inner portions of the anchor assembly, extension 150 no longer supports locking key 232 in profile 330. As this point the entire anchor assembly may be retrieved to the surface.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for controlling a connection speed of fiber optic connectors in a subterranean well comprising:

a first assembly positionable in the well, the first assembly including a first fiber optic connector and a first optical fiber; and a second assembly including a second fiber optic connector and a second optical fiber, the second assembly having an outer portion and an inner portion with a transfer piston positioned therebetween, the outer portion selectively axially shiftable relative to the inner portion, wherein, upon engagement of the first assembly with the second assembly, axially shifting the outer portion of the second assembly in a first direction relative to the inner portion of the second assembly meters a fluid through the transfer piston which controls the speed at which the outer and inner portions of the second assembly axially shift relative to one another allowing the first and second fiber optic connectors to be operatively connected to each other at a predetermined connection speed, thereby optically coupling the first and second optical fibers.

2. The apparatus as recite in claim 1 wherein the first assembly further comprises a completion assembly positionable in the well and the second assembly further comprises an anchor assembly operable to be run in the well on a tubing string.

3. The apparatus as recited in claim 2 wherein engagement of the first assembly with the second assembly further comprises inserting an orienting key of the anchor assembly into an orienting guide of the completion assembly to rotate the anchor assembly relative to the completion assembly, thereby circumferentially aligning the first fiber optic connector with the second fiber optic connector.

4. The apparatus as recited in claim 1 wherein the first optical fiber further comprises a plurality of first optical fibers, wherein the second optical fiber further comprises a plurality of second optical fibers and wherein each of the first optical fibers is optically coupled to one of the second optical fibers upon connection of the first fiber optic connector with the second fiber optic connenctor.

5. The apparatus as recited in claim 1 wherein the inner portion of the second assembly further comprises a lock and the outer portion of the second assembly further comprises a collet assembly, the lock initially coupling the outer and inner portions of the second assembly together and the collet releasing the lock in response to being radially inwardly compressed by an inner surface of the first assembly.

6. The apparatus as recited in claim 5 wherein, after releasing the lock, the collet of the outer portion of the second assembly operably engages with a profile of the inner surface of the first assembly to secure the second assembly within the first assembly.

7. The apparatus as recited in claim 1 further comprising a spring positioned between the outer portion of the second assembly and the inner portion of the second assembly such that additional axially shifting of the outer portion of the second assembly in the first direction relative to the inner portion of the second assembly after connecting the first and second fiber optic connectors creates a biasing force between the first and second fiber optic connectors opposing disconnection thereof.

8. The apparatus as recited in claim 1 wherein the first assembly further comprises a packer and the first downhole connector of the first assembly is positioned at a location uphole of the packer.

9. A method for controlling a disconnection speed of fiber optic connectors in a subterranean well comprising:

establishing a predetermined tensile force between a first assembly and a second assembly in the well, the first assembly including a first fiber optic connector and a first optical fiber, the second assembly including a second fiber optic connector and a second optical fiber;

axially shifting an outer portion of the second assembly relative to an inner portion of the second assembly while metering a fluid through a transfer piston to control the speed at which the outer and inner portions of the second assembly axially shift relative to one another; and operatively disconnecting the first and second fiber optic connectors from each other, thereby optically decoupling the first and second optical fibers.

10. The method as recited in claim 9 wherein establishing the predetermined tensile force between the first assembly and the second assembly in the well further comprises releasing the outer portion of the second assembly from a connection with the first assembly.

11. The method as recited in claim 10 wherein releasing the outer portion of the second assembly from the connection with the first assembly further comprises radially inwardly compressing a collet assembly of the second assembly with an inner surface of the first assembly.

12. The method as recited in claim 9 wherein establishing the predetermined tensile force between the first assembly and the second assembly in the well further comprises removing a biasing force between the first and second fiber optic connectors opposing disconnection thereof.

13. The method as recited in claim 9 wherein the first optical fiber further comprises a plurality of first optical fibers, wherein the second optical fiber further comprises a plurality of second optical fibers and wherein operatively disconnecting the first and second fiber optic connectors from each other further comprises optically decoupling each of the first optical fibers from one of the second optical fibers.

14. A method for controlling connection and disconnection speeds of fiber optic connectors in a subterranean well comprising:

positioning a first assembly having a first fiber optic connector and a first optical fiber in the well;

engaging the first assembly with a second assembly having a second fiber optic connector and a second optical fiber;

axially shifting an outer portion of the second assembly relative to an inner portion of the second assembly in a first direction while metering a fluid through a transfer piston to control the axial shifting speed thereof;

operatively connecting the first and second fiber optic connectors to each other to optically couple the first and second optical fibers;

establishing a predetermined tensile force between the first assembly and the second assembly;

axially shifting the outer portion of the second assembly relative to the inner portion of the second assembly in a second direction while metering the fluid through the transfer piston to control the axial shifting speed thereof; and operatively disconnecting the first and second fiber optic connectors from each other to optically decoupling the first and second optical fibers.

15. The method as recited in claim 14 wherein axially shifting the outer portion of the second assembly relative to the inner portion of the second assembly in the first direction further comprises releasing a lock initially coupling the outer and inner portions of the second assembly.

16. The method as recited in claim 15 wherein releasing the lock initially coupling the outer and inner portions of the second assembly further comprises radially inwardly compressing a collet assembly of the outer portion of the second assembly with an inner surface of the first assembly.

17. The method as recited in claim 14 further comprising securing the second assembly within the first assembly by engaging a collet assembly of the outer portion of the second assembly with a profile of the first assembly.

18. The method as recited in claim 17 wherein establishing the predetermined tensile force between the first assembly and the second assembly in the well further comprises releasing the collet assembly of the outer portion of the second assembly from the profile of the first assembly.

19. The method as recited in claim 14 wherein establishing the predetermined tensile force between the first assembly and the second assembly in the well further comprises removing a biasing force between the first and second fiber optic connectors opposing disconnection thereof.

20. The method as recited in claim 14 wherein the first optical fiber further comprises a plurality of first optical fibers, wherein the second optical fiber further comprises a plurality of second optical fibers, wherein operatively connecting the first and second fiber optic connectors to each other further comprises optically coupling each of the first optical fibers to one of the second optical fibers and wherein operatively disconnecting the first and second fiber optic connectors from each other further comprises optically decoupling each of the first optical fibers from the respective one of the second optical fibers.

21. The method as recited in claim 14 wherein the axial shifting speed of the outer portion of the second assembly relative to the inner portion of the second assembly in the first direction is less than the axial shifting speed of the outer portion of the second assembly relative to the inner portion of the second assembly in the second direction such that the connection speed of the first and second fiber optic connectors is less than the disconnection speed.

22. The method as recite in claim 21 wherein the transfer piston is more restrictive to flow of the metering fluid therethrough in the first direction than in the second direction.

* * * * *